US006755755B2

(12) United States Patent
Wah Loh

(10) Patent No.: US 6,755,755 B2
(45) Date of Patent: Jun. 29, 2004

(54) SPORTS SKILLS TRAINING ARRANGEMENT

(76) Inventor: James Cheng Wah Loh, 8818 E. Emperor Ave., San Gabriel, CA (US) 91775

( * ) Notice: Subject to any disclaimer, the term of this patent is extended or adjusted under 35 U.S.C. 154(b) by 0 days.

(21) Appl. No.: 10/199,161

(22) Filed: Jul. 19, 2002

(65) Prior Publication Data

US 2002/0193188 A1 Dec. 19, 2002

Related U.S. Application Data

(63) Continuation-in-part of application No. 09/561,144, filed on Apr. 28, 2000, now abandoned.

(51) Int. Cl.[7] ..... A63B 69/00; A63B 69/36

(52) U.S. Cl. ..... 473/458; 473/450; 473/464; 473/212; 473/215; 119/770; 482/131

(58) Field of Search ..... 473/458, 450, 473/464, 461, 212–216, 59, 422, FOR 106; 119/801, 802, 804, 857, 863–865, 714, 774, 776, 795, 796–798; 482/121, 122, 127, 124, 907, 908

(56) References Cited

U.S. PATENT DOCUMENTS 2,103,502 A * 12/1937 Webster ..... 473/215
3,937,465 A * 2/1976 Roland ..... 473/461
4,359,221 A * 11/1982 Taylor ..... 473/63
5,188,365 A * 2/1993 Picard ..... 473/213
5,397,122 A * 3/1995 Herridge, II ..... 473/212
5,518,486 A * 5/1996 Sheeler ..... 482/131
5,718,189 A * 2/1998 Blake ..... 119/770
5,885,175 A * 3/1999 Marquez ..... 473/464
5,938,548 A * 8/1999 Upshaw ..... 473/453
6,012,993 A * 1/2000 Guerriero ..... 473/424
6,027,413 A * 2/2000 Smith et al. ..... 473/215
6,095,936 A * 8/2000 Kirkpatrick et al. ..... 473/450
6,196,931 B1 * 3/2001 Wilt ..... 473/212
6,270,430 B1 * 8/2001 Nicoloff ..... 473/458
6,283,877 B1 * 9/2001 Cook ..... 473/450

* cited by examiner

*Primary Examiner*—Gregory Vidovich
*Assistant Examiner*—Mitra Aryanpour
(74) *Attorney, Agent, or Firm*—Raymond Y. Chan; David and Raymond Patent Group

(57) ABSTRACT

A sports skills training arrangement, which is provided to promote muscle memory of a user, includes an arm loop strap adapted for fittingly encircling an upper arm of the user, a tension strap having a first end and a second end attached to the arm loop strap, a body connector affixed to the first end of the tension strap for detachably attaching to a waist portion of the user, a waist adjuster defining a control portion of the tension strap between the second end thereof and the waist adjuster and a waist loop portion of the tension strap for fittingly fastening around the waist portion of the user, and a length adjustment buckle for adjusting a length of the control portion of the tension strap. Therefore, a distance between the arm and the waist portion of the user is limited to promote coordinated arm and body movements.

4 Claims, 9 Drawing Sheets

SPORTS SKILLS TRAINING ARRANGEMENT

CROSS-REFERENCE OF RELATED APPLICATION

This is a Continuation-In-Part application of a non-provisional utility application, application Ser. No. 09/561,144, filed Apr. 28, 2000 ABN.

BACKGROUND OF THE PRESENT INVENTION

1. Field of Invention

The present invention relates to a sports training device, and more particularly to a sports skills training strap for training muscles and establishing muscle memory patterns for more compact, efficient and powerful strokes for sports activities requiring a swinging motion of the arms, such as in tennis, golf, baseball and basketball.

2. Description of Related Arts

What weekend tennis player doesn't wish he or she could serve a ball 100 miles per hour. What weekend golfer doesn't wish she or he was able to drive a ball 300 yards and in the middle of the fairway on every tee shot. What baseball or softball doesn't wish he could make that perfect compact powerful swing? What basketball player doesn't wish she could shoot the perfect jump shot? Professional tennis players, golfers, baseball and basketball players do achieve these athletic feats, but what sets these professionals apart from weekend athletes is their ability to swing a tennis racquet or a golf club, hit a baseball faster and farther, or shoot a basketball with better accuracy, speed, power, compactness, and efficiency. All these professional athletes achieve these qualities after hours of practice, and years of training. They practice repetitive strokes to build a pattern for their muscles to "memorize," i.e. "muscle memory." These professional athletes often have trainers and coaches, and the time to practice swinging their racquets or clubs to improve their swings, or to take shot after shot. The trainers and coaches watch the motions of the athlete, telling him or her what he or she is doing wrong, or how to better move their bodies and arms. Weekend athletes usually cannot afford trainers, coaches to analyze each movement, or to give them feed back on how a swing or a basketball shot should feel.

Often in sports, the ability to hit a ball farther, or more accurately is a combination of power and speed of the individual's movements. The swing, in the case of golf, tennis or baseball is a combination of an athlete's swinging of her arms, and a twisting or turning of her whole body, working in unison to create the speed and power to transmit to the ball at impact. A person's body weight may be important, but technique is equally important. Tennis players tend to be very thin and not very muscular. Yet, come professional golf, Ian Woosnan and Sergio Garcia, two of the shortest (Woosnan), and slimmest (Garcia) players hit for a greater distance than other professionals who are taller and stronger. Mark McGwire uses a combination of a compact swing, quick bat speed, and strength to hit his home runs.

In basketball, how well one shoots is often dependent upon her technique. In professional basketball, great shooters have shooting percentages around 50%, not a high number. Thus, shooting skill is a premium commodity. How one raises her arm and moves her arms and wrists when shooting the basketball affect the shot. Having proper fundamentals is essential. One lesson taught over and over is to shoot the ball with greater arc. Being able to shoot a ball from a great distance, with sufficient arc, is a great advantage. However, to be able to do that, one requires both technique and power.

In tennis and golf, or any other sports requiring the athlete to swing some sort of "hitting instrument," the goal is the same: to produce an efficient, smooth, accurate and powerful swing. In general, a swing works in the following manner: an individual, from a set position, holds a tennis racquet or a golf club, i.e., the "hitting instrument," in a set position. She then swings the hitting instrument back in an arc, twisting her body, and guiding the hitting instrument by her hands and arms, to a predetermined point. This is her "backswing." She then proceeds to swing the club back down along the same plane generating speed and power as the hitting instrument moves to make contact with the ball, which may or may not be moving (in golf, the ball is stationary, and in tennis, the ball is moving) in a "contact area." The individual then continues swinging the hitting instrument through the contact area through a "follow through," ending the swing at some point in the follow through. The combination of backswing, swinging through the contact area, and the follow through create the power and speed, and accuracy necessary for each swing. The amount of backswing, speed and power through the contact area, and the amount of follow through required for each swing affects the distance the ball goes and the speed of the ball.

In tennis, an individual moves her body to the right or left standing at a right angle to the direction of the ball, as she makes her backswing. She then swings her arm forward and rotates her body as she hits the approaching ball and then continues through her follow through. The swing may be a vertical motion, over her head, or around either side of her body. The length of the backswing and follow through determine the speed and distance of the shot. The majority of the swings are full swings. But there is also "volleying," which involves very little backswing, and a short follow through after contact.

In golf, similar requirements as in tennis exist for the golfer's swing. Although the individual's feet do not move during the swing as in tennis, but a golfer also rotates her body and arms in the same direction as the golfer makes her backswing, begins moving her arms forward through the contact area and completes her follow through. On a typical swing, an overextended backswing often results in a mishit or a loss of distance because the proper coordination of body and arms is not achieved so that the forward swing is not on the same plane as the backswing. Furthermore, a golfer with a habitual abbreviated follow through, or no follow through, finds it difficult to hit the ball straight consistently, and also may decelerate his swing, resulting in either a weakly hit ball, or a mishit. Also, proper positioning of the body relative to the arms and hands throughout the swing is needed to generate power, and keep the golf club moving along the same plane. This is especially true for shots in which the golfer may not make a full swing, but still needs the body and arms to be coordinated in their movements, such as two swinging motions, "pitching" and "chipping."

In baseball, the player starts with his arm, and the club already in a set position behind him. He may twist his hips back slightly to help generate the power required in the back swing before twisting them forward as he swings his arms and hands through the hitting area, shifting his weight forward slightly and turning his wrists and straightening his arms.

But in all the sports, the basic rotation of the hips, turning the body to follow the rotation of the arms during the swing is the same. The individual may use one hand or two hands to swing the hitting instrument, depending upon the sport. In all of the sports, however, the power and speed generated in the swing are a combination of the swinging of the hands and arms, and the twisting and untwisting of the body, and the hips, specifically, and the strength in the legs. Every individual, in learning how to swing the hitting instrument, strives to swing the hitting instrument using a proper combination of swinging his arms, turning his wrists, and rotating and twisting his trunk to promote a fast, powerful swing.

In all these sports, emphasis is placed on creating a compact swing that stores energy on the backswing, generating power, transferring the energy from the swinging instrument to the ball as contact is made through a hitting area between the swinging instrument (such as a racquet or a club) and the ball. Furthermore, in those sports the position of the arms and the body during the back swing, at the time of contact, and the follow through are all important to achieving a powerful, accurate and efficient swing.

In basketball, players must learn how to shoot the ball properly. In professional basketball, a premium is placed on being able to shoot the basketball. A good shooter typically will make only around 50% of his jump shots. This requires both power and skill. Power for shooting comes from the movement of power from the feet and legs, through the waist, shoulders, elbow, wrist and finally the fingers. Often times, an individual learning to shoot a basketball, will keep her hands high over her head, and use only her wrists. This will often cause the ball to go straighter, and with less arc, decreasing her chances of making the shot. In addition, she cannot use the power in her body to propel the ball up from her shoulders or elbows and in a higher arc, and from a greater distance, thus limiting her effectiveness. When the ball is positioned so that it is almost level with the head, the individual can more effectively shoot the basketball, using more power to push the ball up in an arc. The individual can push his arms upwards, using his legs, body and arms to propel the ball in a high arc towards the basket.

As amateurs, the average weekend athlete, like the professional athlete, also desires to learn how to hit a golf ball or a tennis ball faster, farther, more accurately, and with greater efficiency, or how to shoot a basketball more fluidly and accurately. But the weekend athlete may not have either the time to practice, or the opportunity to obtain professional instruction that is available to a professional athlete, to improve her swing or her motion. As a result, a number of training devices have cropped up, designed to enable the weekend athlete to achieve a better swing, whether it be in golf, tennis, racquetball, softball, or in any sport where swinging some club, or bat, or racquet is required, or designed to teach an individual how to properly use her arms when shooting a basketball.

Golf in particular is a sport where new swing aids are introduced daily. The goals are always to teach the golfer to keep her arms close to her body, not to overswing, and to swing so that contact is made cleanly. In the case of golf, much of this is tied to the backswing and the follow through of the golf club. In tennis, the emphasis of training aids has been traditionally to teach the tennis player how to move her body perpendicular to the approach of the ball to begin her swing. In basketball, it is the motion of the hands and arms as the individual shoots the basketball.

One problem for a weekend athlete is that today's training aids are too limited in what they can be used to train. Present day training aids in each sport are directed to a specific skill. As a result, an individual learning several sports may be required to obtain different training aids for each sport. Also, training aids are often cost prohibitive, requiring an individual to spend a fair amount of money for each training aid. In golf, in particular, there are many swing training aids that are used for training specific movements. The result is that a golfer buying those training aids must buy more aids, and spend more money to own each of these separate swing training aids. Often, these swing training aids are not something a golfer can even use with her golf clubs. Thus, the golfer must try to adapt what she has learned with the swing training aid to her swing with her golf clubs. Golfers often lament that they hit well at a driving range, but not when they are playing a game. A training aid not used in conjunction with hitting a golf ball can be less instructive.

For tennis, the main training aid is a ball machine that shoots balls to either side of the player, so she may practice her tennis strokes from either side of her body.

Baseball, like tennis offers few training aids that a person may use to help him memorize an effective swing pattern.

In basketball, there are few, if any, training aids to help the individual learn how to shoot a basketball with the proper wrist and arm motion.

What is needed is a low cost interchangeable training aid that can be used in several sports for several different types of swings by an individual while she is practicing with her respective hitting instrument or for any other uses requiring her to coordinate the movements of her arm alone or in conjunction with her body.

A conventional training strap comprises a tension strap having a first end and a second end, a fastener provided at the first end of the tension strap for detachably fastening on a belt loop of an individual's pants, and an arm loop provided at the second end of the tension strap for detachably fastening on an upper arm of the individual in such a manner that by adjustably controlling the length of the tension strap, a distance between the individual's arm and the individual's waist, so as to guide the arm of the individual to perform a swinging motion with respect to the body thereof.

However, the conventional training strap has several drawbacks. Since the arm loop has a predetermined width, the arm loop tends to slidably move along the individual's arm when swinging. In order to guide the correct swinging motion of the individual's arm, the arm loop must be fastened on a lower portion of the individual's arm. Therefore, the unwanted sliding movement of the arm loop may cause an improper arm swinging movement with respect to his body turn. Even though the arm loop can be tightly fastened on the individual's arm, the individual may feel uncomfortable and hurt his muscle when the arm loop is fastened too tight on the arm.

In addition, when performing the swinging motion, the body turn of the individual will pull the pants to move through the tension strap. Since the pulling force on the tension strap will create stress on the belt loop, the stress will either tear the belt loop or pull the pants to move around the individual's waist. Therefore, the unwanted twisting movement of the individual's pants may cause an improper turn of the body as the individual swings his body forward.

SUMMARY OF THE PRESENT INVENTION

A main object of the present invention is to provide a sports skills training arrangement for promoting a muscle memory of a human body, wherein the training arrangement is capable of connecting an athlete's arm or arms to his body that creates tension when an individual overswings while swinging a hitting instrument through her backswing, promoting a muscle memory pattern for a more compact backswing.

Another object of the present invention is to provide a sports skills training arrangement, which comprises a waist loop strap for encircling a waist portion of the human body, so as to prevent an unwanted twisting movement of the pants.

Another object of the present invention is to provide a sports skills training arrangement, wherein an arm loop strap having a predetermined width comfortly and securely encircles an upper arm of the human body so as to prevent an unwanted sliding movement of the arm loop strap along the arm of the human body while performing the swinging motion.

Another object of the present invention is to provide a sports skills training arrangement that creates tension when an individual overswings while swinging a hitting instrument through her backswing, promoting a muscle memory pattern for a more fluid swing.

Another object of the present invention is to provide a sports skills training arrangement that creates tension when an individual overswings while swinging a hitting instrument through her backswing, promoting a muscle memory pattern to keep a individual's forward swing pattern on the same plane as her backswing.

Another object of the present invention is to provide a sports skills training arrangement device connecting an athlete's arm or arms to his body that creates tension when an individual overswings while swinging a hitting instrument through her backswing, thereby promoting a muscle memory pattern for an individual's body to rotate in a coordinated movement in the same direction as the individual's arms as the individual swings the hitting instrument back through her backswing.

Another object of the present invention is to provide a sports skills training arrangement device connecting an athlete's arm or arms to his body so as to create tension when an individual overswings while swinging a hitting instrument through her forward swing, thereby promoting a muscle memory pattern for an individual's body to rotate in a coordinated movement in the same direction as the individual's arms as the individual swings the hitting instrument through the contact area.

Another object of the present invention is to provide a sports skills training arrangement device connecting an athlete's arm or arms to her body that that creates tension as the individual rotates her arms through the hitting area and through her follow through promoting a coordinated muscle memory pattern for a complete rotation of the individual's body as she swings her hitting instrument past the hitting area and through her follow through.

Another object of the present invention is to provide a sports skill training strap, which is capable of connecting an individual's upper arm to his waist in order to force him to keep his arm down when preparing to shoot, and enabling him to practice using his whole body in coordination with his arm, elbow and wrist as he shoots the basketball, promoting a coordinated muscle memory pattern for a fluid one-piece shooting motion.

Another object of the present invention is to provide a sports skills training arrangement of a simple design to promote muscle memory patterns for a variety of swings for a variety of sports.

Another object of the present invention is to provide a sports skills training arrangement for promoting muscle memory that is inexpensive to manufacture.

Accordingly, in order to accomplish the above objects, the present invention provides a sports skills training arrangement for promoting muscle memory of a human body, comprising:

an arm loop strap adapted for encircling an upper arm of the human body, wherein the arm loop strap which has a predetermined length made of elastic material comprises a loop size adjuster connecting a first end portion and a second end portion of the arm loop strap to define an arm loop, wherein the loop size adjuster is adapted to adjust a diameter of the arm loop to equal to a diameter of a lower portion of the upper arm so as to fittingly fasten around the lower portion of the upper arm of the human body and prevent an axial movement thereof;

a fibrous length-adjusting tension strap having a first end and a second end attached to the arm loop strap;

a body connector affixed to the first end of the tension strap adapted for detachably attaching to a specific connection point of a waist portion of the human body;

a waist adjuster, which is slidably mounted on the tension strap, defining a control portion of the tension strap between the second end thereof and the waist adjuster and a waist loop portion of the tension strap formed by connecting the body connector to the waist adjuster, wherein the waist adjuster is adapted to adjust a diameter of the waist loop portion to equal to a diameter of the waist portion of the human body so as to fittingly fasten around the waist portion of the human body; and a length adjustment means which is provided on the tension strap for adjusting a length of the control portion of the tension strap.

DETAILED DESCRIPTION OF THE PREFERRED EMBODIMENT

Figure 1:
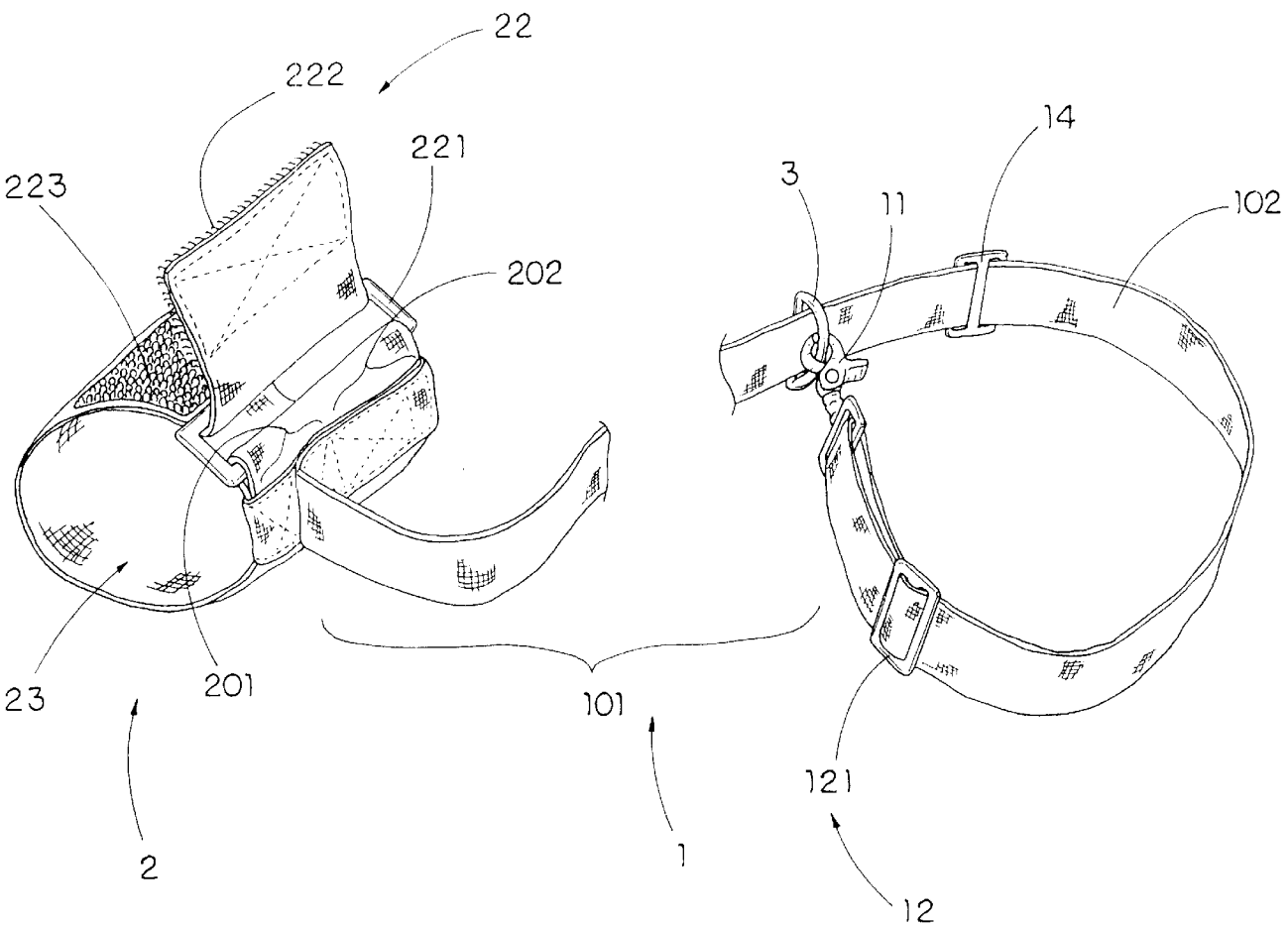
FIG. 1 is a perspective view of a sports skills training arrangement for promoting muscle memory of a user's human body according to a first preferred embodiment of the present invention.
Figure 2A:
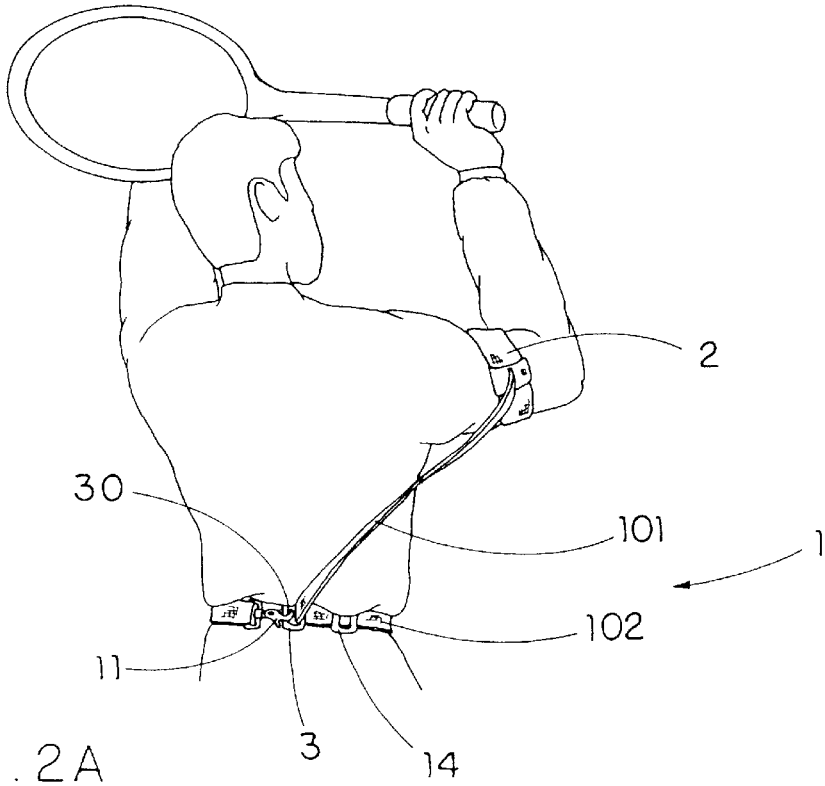
FIGS. 2A through 2D are perspective views of a human body using the sports skills training arrangement according to the above first preferred embodiment of the present invention, showing the sports skills training arrangement guiding a swinging movement of the individual's arm while the individual swings a tennis racquet.
Figure 2B:
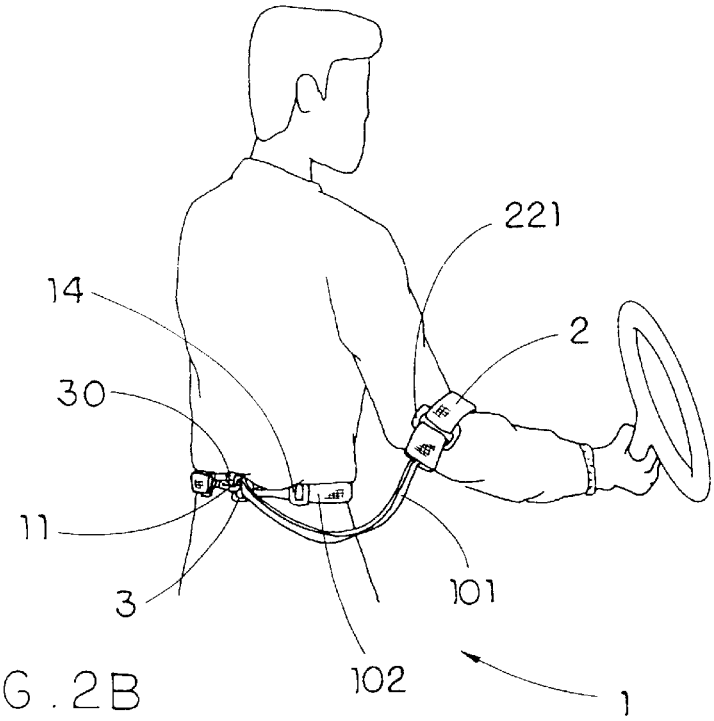
Figure 2C:
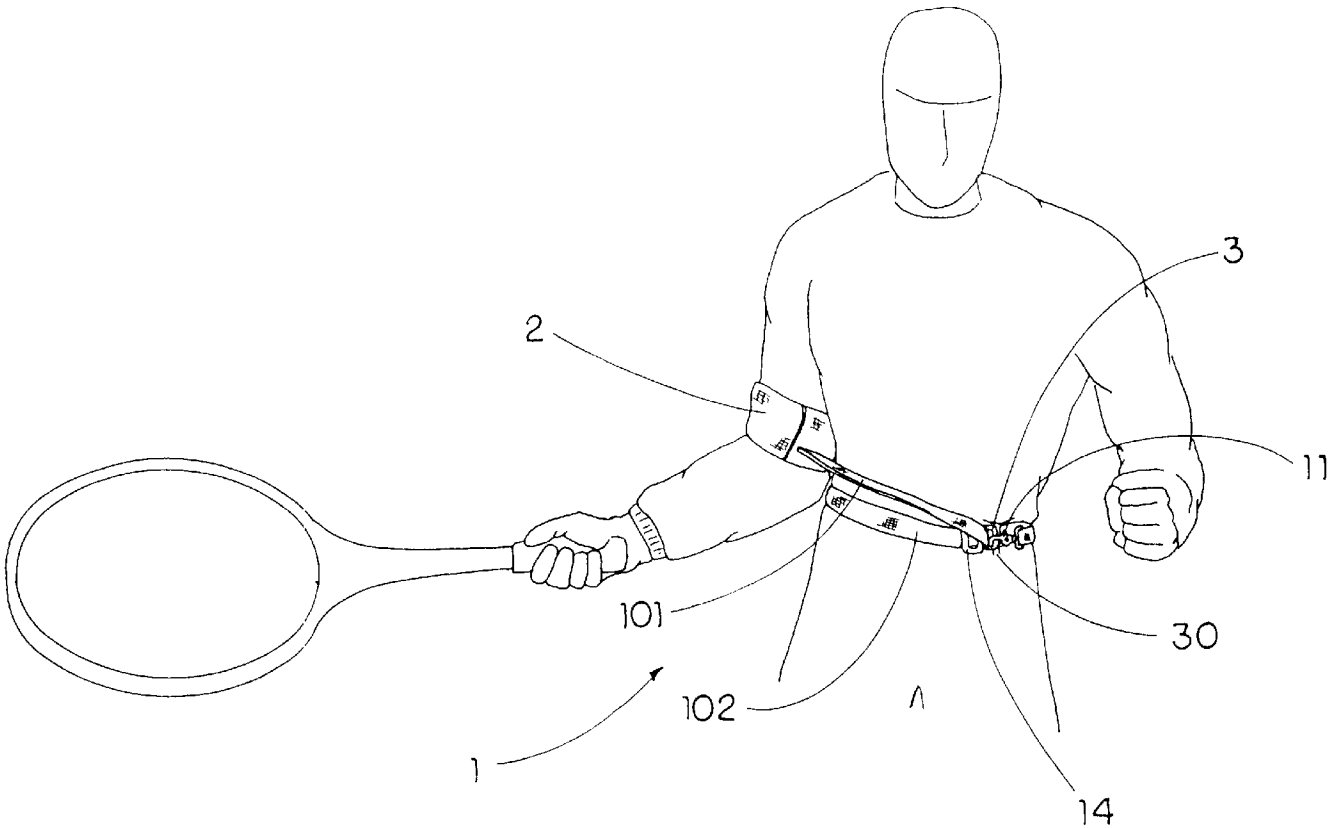
Figure 2D:
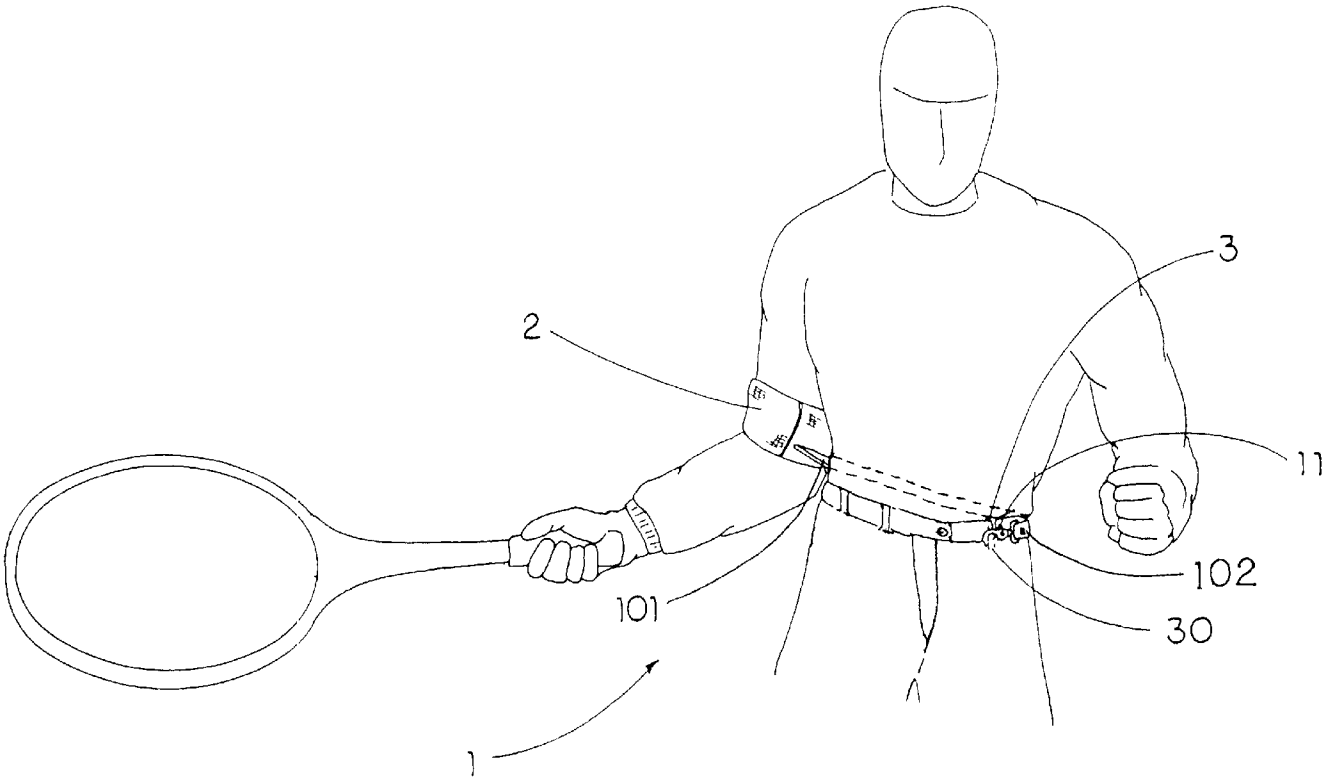

Referring to FIG. 1 of the drawings, a sports skills training arrangement for promoting muscle memory of a user's human body according to a first preferred embodiment is illustrated, wherein the sports skills training arrangement comprises an arm loop strap 2, a fibrous length-adjusting tension strap 1, a body connector 11 and a waist adjuster 3.

The arm loop strap 2 is adapted for encircling an upper arm of the human body, wherein the arm loop strap 2 which has a predetermined length made of elastic material comprises a loop size adjuster 22 connecting a first end portion and a second end portion of the arm loop strap 2 to define an arm loop 23, wherein the loop size adjuster 22 is adapted to adjust a diameter of the arm loop 23 to equal to a diameter of a lower portion of the upper arm so as to fittingly fasten around the lower portion of the upper arm of the human body and prevent an axial movement thereof.

The fibrous length-adjusting tension strap 1, according to the preferred embodiment, has a first end and a second end attached to the arm loop strap 2.

The body connector 11 is affixed to the first end of the tension strap 1 adapted for detachably attaching to a specific connection point of a waist portion of the human body.

The waist adjuster 3, which is slidably mounted on the tension strap 1, defining a control portion 101 of the tension strap 1 between the second end thereof and the waist adjuster 3 and a waist loop portion 102 of the tension strap 1 formed by connecting the body connector 11 to the waist adjuster 3, wherein the waist adjuster 3 is adapted to adjust a diameter of the waist loop portion 102 to equal to a diameter of the waist portion of the human body so as to fittingly fasten around the waist portion of the human body.

The training arrangement further comprises a length adjustment means 12 which is provided on the tension strap 1 for adjusting a length of the control portion 102 of the tension strap 1.

As shown in FIG. 1, the loop size adjuster 22 comprises a loop size adjusting ring 221 securely attached to the first end portion of the arm loop strap 2 and a first and second fasteners 222, 223 provided two opposed sides of the second end portion of the arm loop strap 2 respectively in such a manner that when the second end portion of the arm loop strap 2 is slidably passed through the loop size adjusting ring 221, the second end portion of the arm loop strap 2 is overlapped to detachably fasten the first fastener 222 to the second fastener 223 so as to form the arm loop 23. Moreover, the diameter of the arm loop 23 is capable of adjusting by overlapping a length of the second end portion of the arm loop strap 2.

Accordingly, the first and second fasteners 222, 223 are loop and hook fasteners respectively affixed to the upper side and the bottom side of the arm loop strap 2 respectively.

It is obvious that the loop size adjusting ring 221 can be constructed as a conventional strap adjusting member having two parallel sliding slots such that the first end portion of the arm loop strap 2 can be slidably and adjustably sidling through the loop size adjusting ring 221 and the second end portion of the arm loop strap 2 is attached to the loop size adjusting ring 221 so as to form the arm loop 23 and adjust the diameter of the arm loop 23 without using the first and second fastener 222, 223. In other words, the circumference of the arm loop 23 is decreased by sliding more of the arm loop strap 2 through the loop size adjusting ring 221.

Of course, the first and second fasteners 222, 223 can be provided on the first and second end portions of the arm loop strap 2 respectively without using the loop size adjusting ring 221 such that the arm loop 23 is formed by directly attaching the first and second fasteners 222, 223 with each other. However, the arm loop strap 2 is preferably made of elastic material to facilitate the attachment with the user's arm and adjust the diameter thereof for fitting to all arm size of the user. It is contemplated that any of the embodiments may have this alternative loop size adjuster 22.

According to the preferred embodiment, the length adjustment means 12 comprises a length adjustment buckle 121 attached to the tension strap for adjusting the length of the control portion 101 of the tension strap 1, wherein the tension strap 1 frictionally passes through an opening in the length adjustment buckle forming a tension strap loop having a circumference whereby as the length adjustment buckle is slid along the length of the tension strap, the circumference of the tension strap loop decreases as the length of the control portion 101 increases, and the circumference of the tension strap loop increases as the length of the control portion 101 decreases.

As shown in FIG. 1, the arm loop strap 2 further has a longitudinal control region 201 to attach the second end of the tension strap 1 and a longitudinal retaining region 202 extended sidewardly from the control region 201 for retaining the arm loop strap 2 around the upper arm of the human body in position, wherein a width of the arm loop strap 2 equals to a total width of the control region 201 and the retaining region 202. In other words, the width of the arm loop strap 2 is lengthened to encircle the upper arm of the human body so as to prevent the arm loop strap 2 from unintentionally sliding along the upper arm of the human body while performing a swinging motion thereof.

As shown in FIG. 1, the second end of the tension strap 1 is perpendicularly attached to the arm loop strap 2 at the control region 201 thereof by stitching. It is worth mentioning that when the individual promotes a swinging movement of his or her arm to force his or her hips to rotate in the direction of his or her swing, the tension strap 1 will perpendicularly pull the loop arm strap 2 for guiding the arm swinging movement. Therefore, the perpendicular connection between the tension strap 1 and the arm loop strap 2 will ensure the pulling force evenly distributing on the arm loop strap 2.

The tension strap 1 has a predetermined length that is capable of encircling the waist portion of the human body by the waist loop portion 102 and further extended to the arm loop strap 2 via the control portion 101 so as to limit a distance between the waist portion of the human body and the upper arm thereof.

As shown in FIG. 1, the body connector 11 of the tension strap 1 is a convention clipping device for hooking onto a receiving connection 30 that provides on the specific connection point of the waist portion of the human body. Accordingly, the body connector 11 is a spring clip adapted for detachably fastening to the waist portion of the human body.

The waist adjuster 3, according to the preferred embodiment, is a ring shaped quick link such as a steel quick link, wherein the waist adjuster 3 is detachably mounted on the tension strap 1 in a slidably movable manner. In other words, the waist adjuster 3 is capable of slidably moving between the first and second end of the tension strap 1.

The training arrangement further comprises a sliding stopper 14 slidably mounted on the waist loop portion 102 of the tension strap 1 to block up a sliding movement of the waist adjuster 3 along the tension strap 1 when the waist loop portion 102 of the tension strap 1 is encircled around the waist portion of the human body.

As shown in FIGS. 2A through 2D, the receiving connection 30 is a belt loop of pants worn on the human body such that the body connector 11 is arranged to detachably attach to the belt loop located at the waist portion of the human body.

The training arrangement, when in use for tennis training, connects the individual's arm to the individual's body by attaching the body connector 11 to the belt loop of the pants and encircling the tension strap 1 around the waist portion of the human body until the waist adjuster 3 is slid along the tension strap 1 to connect to the body connector 11 to form the waist loop portion 102 of the tension strap 1 around the waist portion of the human body. Since the diameter of the waist loop portion 102 of the tension strap 1 is adapted to be selectively adjusted by sliding the waist adjuster 3 along the tension strap 1, the waist loop portion 102 of the tension strap 1 fits for all waist size of the human body.

It is worth mentioning that when the waist loop portion 102 of the tension strap 1 is encircled around the waist portion of the human body, a pulling force from the arm of the human body through the control portion 101 of the tension strap 1 is evenly distributed on the waist portion of the human body via the waist loop portion 102 of the tension strap 1, so as to ensure the full turn of the human body coordinated with the arm movement. In addition, since the body connector 11 not only connects to the belt loop of the pants but also connects to the waist adjuster 3, the waist loop portion 102 of the tension strap 1 is held around the waist portion of the human body in position, so as to prevent an unwanted twisting movement of the pants while the control portion 101 of the tension strap 1 is pulled upwardly.

Moreover, after encircling the waist loop portion 102 of the tension strap 1 around the waist portion of the human body, one can connect the training arrangement to the upper arm by placing the arm loop strap 2 around one of the arms of the individual and adjusting the loop size adjuster 22 so that the arm loop strap 2 fits snugly around the individual's upper arm or forearm. Therefore, a distance between the waist portion of the human body and the upper arm thereof is limited by the control portion 101 of the tension strap 1 which is extended from the waist adjuster 3 to the arm loop strap 2.

For example, as shown in FIGS. 2A through 2D, the arm loop strap 2 is placed around the individual's right arm and the body connecter 11 is attached to the belt loop on either the front side or the rear side of the pants worn on the human body. As the individual swings the tennis racquet, his or her motion pulls the sports skills training arrangement, forcing his or her hips to rotate in the direction of his or her swing. This promotes a full turn of the body as the individual swings his or her body forward or backward. Therefore, The training arrangement of the present invention is capable of guiding the individual to promote the backswing, forward swing, and the follow through of his or her arm motion to be coordinated in the body turn so as to generate a full power of fluid swinging movement. In other words, the distance between the upper arm and the waist portion of the human body is limited by the control portion 101 of the tension strap 1 to promote coordinated arm and body movements.

Figure 3A:
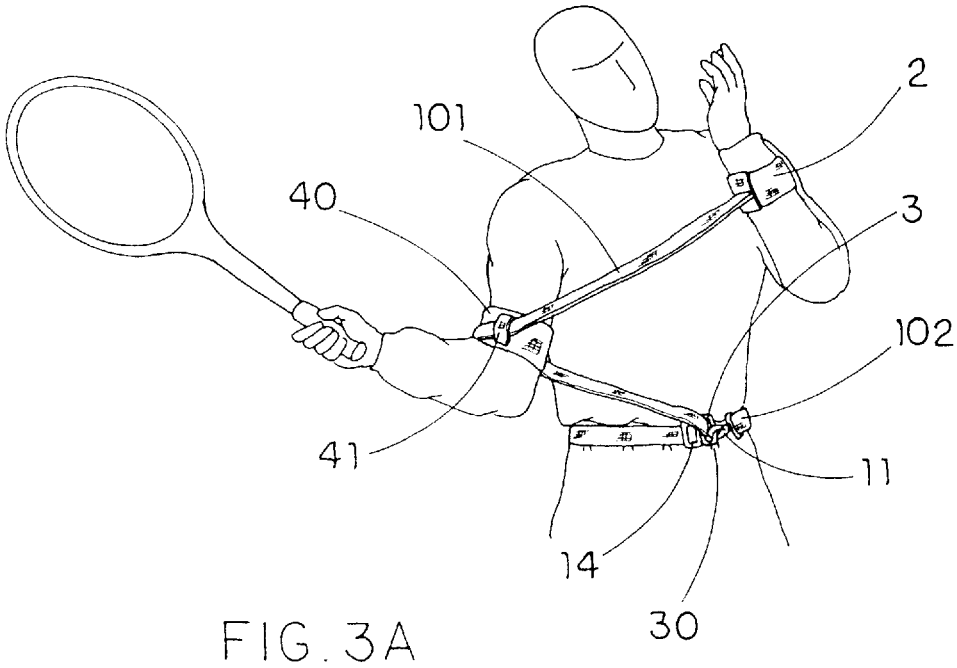
FIGS. 3A and 3B illustrate a first alternative use of the sports skills training arrangement according to the above first preferred embodiment of the present invention.
Figure 3B:
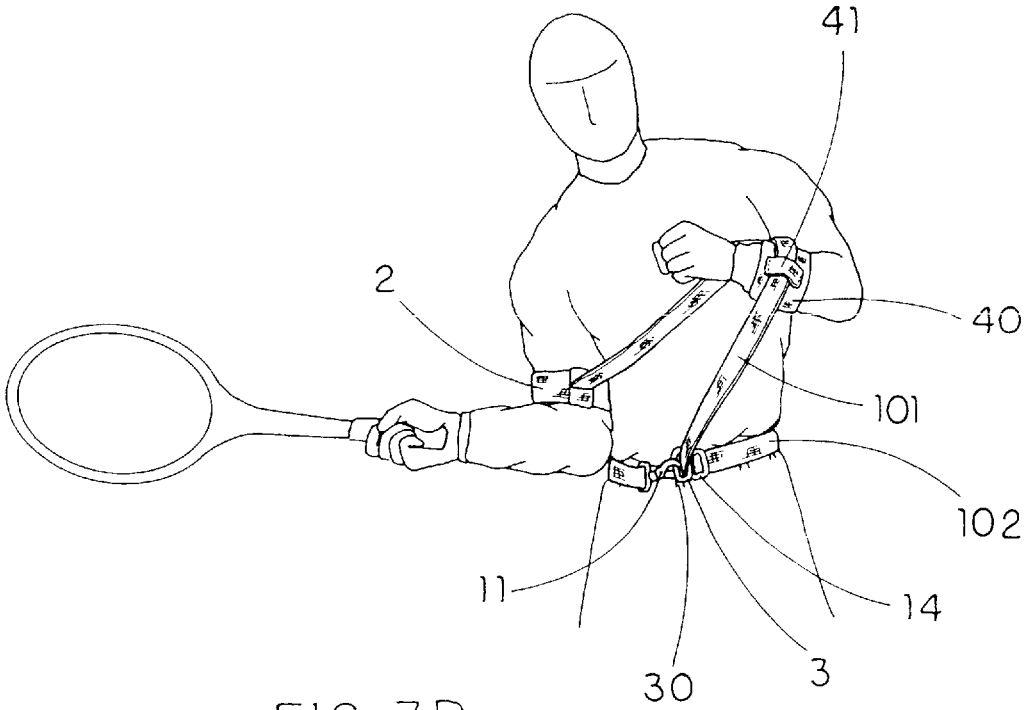

As shown in FIGS. 3A and 3B, an alternative method of use for The training arrangement is to attach the body connector 11 to the belt loop 30 on the front side of the human body as the arm upon which the arm loop strap 2 is placed. The control portion 101 of the tension strap 1 is extended from the body connector 11, i.e. connects to the waist adjuster 3, around the arm on the other side of the individual's body to attach to the arm of the individual on the same side of the body as the body connector 11 is attached. This method of attachment not only forces the individual to rotate his or her hips in the same direction as his or her arm, as his or her pulling action creates tension in the tension strap 1, but also requires the individual to rotate with his or her hips, and twist his or her entire body to hit the ball because the sports training strap wraps around the outer side of his or her other arm causing the individual to use his or her arms in unison when rotating his or her body and thus preventing the individual form rotating his or her shoulders faster than his or her hips.

In order to guide the control portion 101 of the tension strap 1 on the arm of the human body while the arm loop strap 2 is attached on another arm of the human body, The training arrangement further comprises a guiding arm strap 40 adapted for encircling an upper arm of the human body, wherein the arm guiding strap 40 has a guiding loop 41 provided thereon for the control portion 101 of the tension strap 1 slidably passing through in such a manner that the control portion 101 of the tension strap 1 is extended from the waist adjuster 3 to the arm loop strap 2 through the guiding loop 41. Therefore, when the guiding arm strap 40 is attached on the upper arm of the human body while the arm loop strap 2 is attached on another upper arm of the human body, the control portion 101 of the tension strap 1 is guided and retained on the arm of the human body via the guiding arm strap 40, so as to prevent an unwanted sliding movement of the control portion 101 of the tension strap on the upper arm of the human body.

Figure 4:
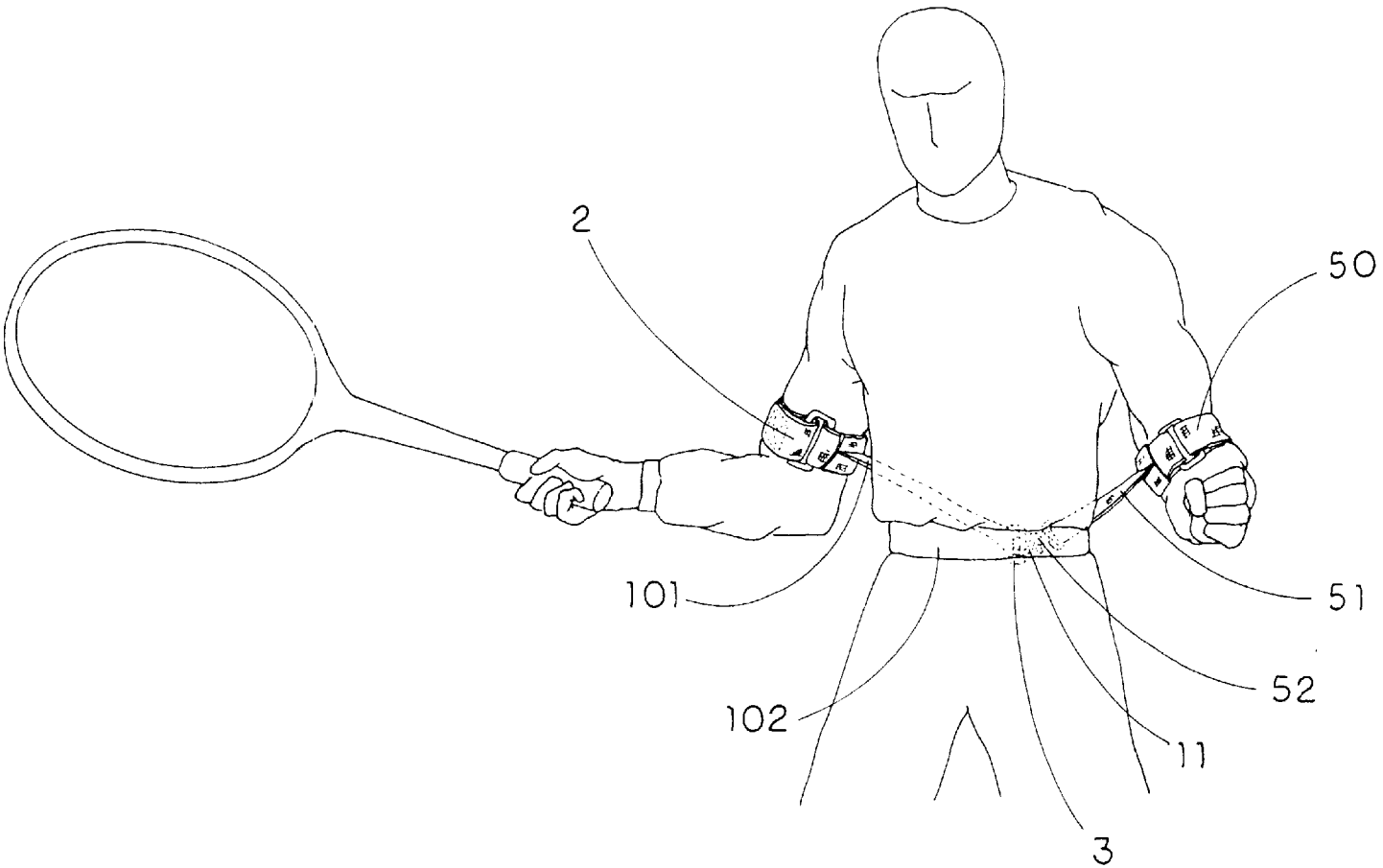
FIG. 4 illustrates a second alternative use of the sports skills training arrangement according to the above first preferred embodiment of the present invention.

As shown in FIG. 4, the sports skills training arrangement further comprises an additional arm loop strap 50 for training in racquet sports. The arm loop strap 2 is fittingly attached to the upper racquet arm of the human body while the additional arm loop strap 50 is fittingly attached to another arm of the human body such that as the individual swings his or her racquet arm forward, his or her other arm is pulled back, thereby promoting a twisting and turning of the hips coinciding with the swing of the racquet.

Accordingly, the additional arm loop strap 50 is constructed as the arm loop strap 2 that is adapted for adjusting a diameter thereof for fittingly around the arm of the human body, wherein a control strap 51, which functions as the control portion 101 of the tension strap 1, is extended from the additional arm loop strap 50 to detachably attach to the waist adjuster 3 via an additional body connector 52 at a rear side of the human body, as shown in FIG. 4.

Figure 5B:
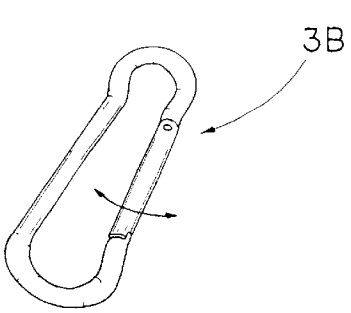
FIGS. 5A through 5D illustrate alternative modes of a waist adjuster of the sports skills training arrangement according to the above first preferred embodiment of the present invention.
Figure 5A:
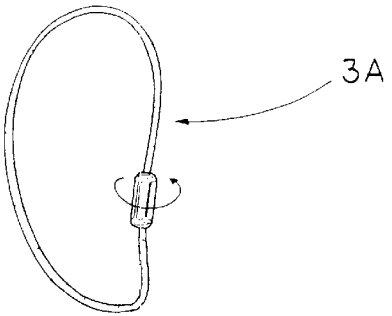
Figure 5C:
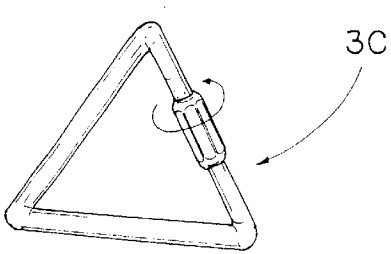

FIGS. 5A through 5C illustrate alternative modes of the waist adjuster 3A, 3B, 3C. The waist adjuster 3A, 3B, 3C can constructed as a pear stainless spring links, a pear stainless quick link, and a delta stainless quick link as shown in FIGS. 5A, 5B, and 5C respectively to slidably connect with the tension strap 1.

Figure 5D:
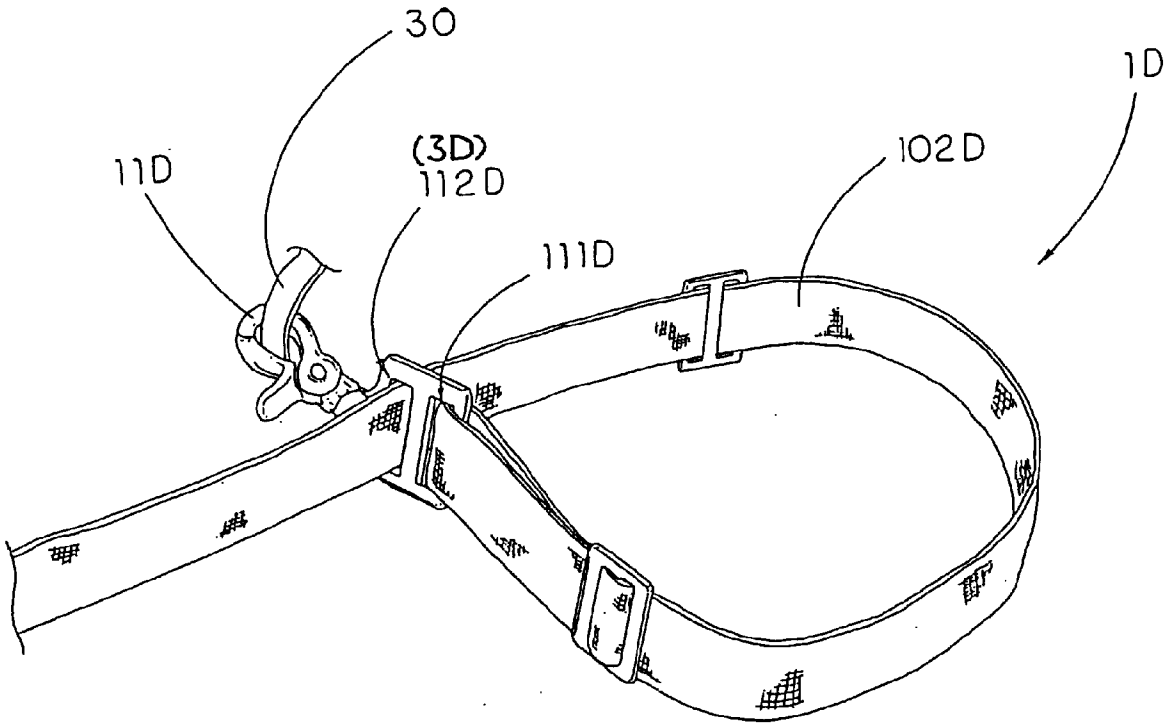

FIG. 5D illustrates another alternative mode of the waist adjuster 3D wherein the waist adjuster 3D is integrally connected with the body connector 11D to form a one-piece member. Accordingly, the body connector 11D has a first elongated sliding slot 111D to securely attach to the first end of the tension strap 1D and a second elongated sliding slot 112D embodied as the waist adjuster 3D for the tension strap 1D slidably passing through. Therefore, the individual is able to directly pull the waist loop portion 102D of the tension strap 1D around the waist portion of the individual and fasten the body connector 11D to the belt loop of the pants worn on the individual.

Figure 6:
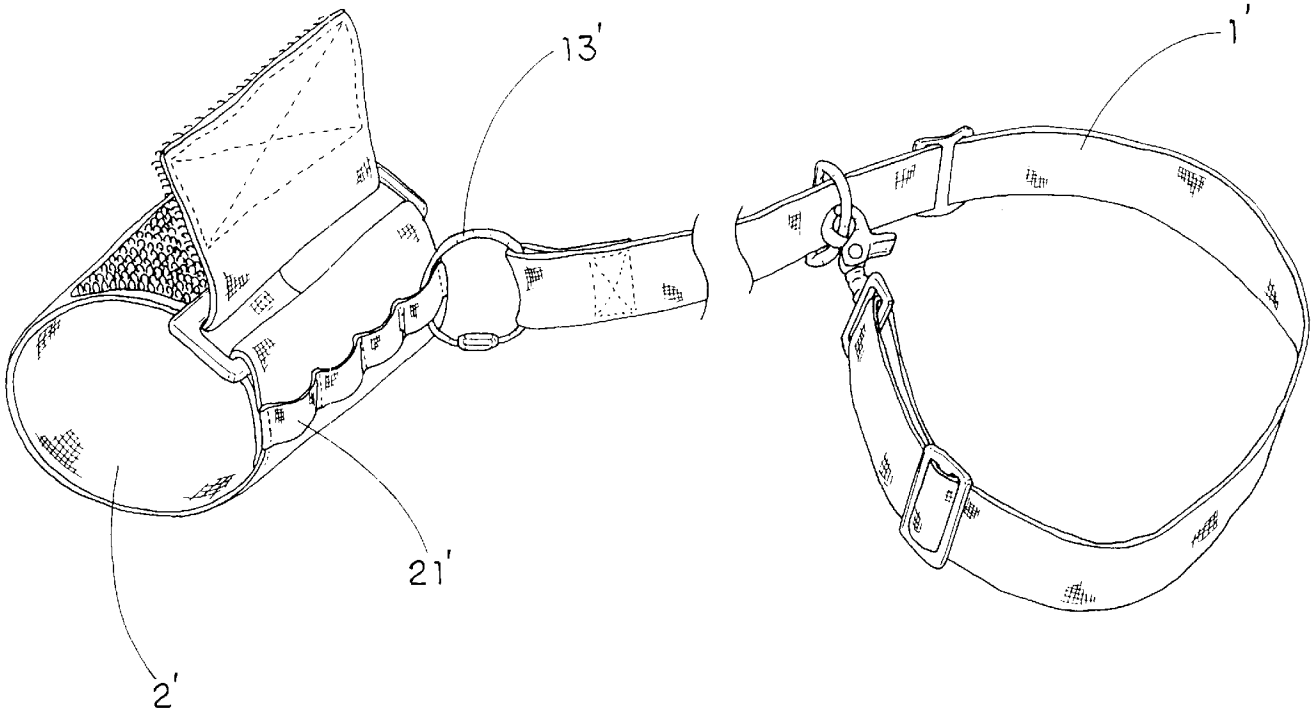
FIG. 6 is a perspective view of a sports skills training arrangement according to a second preferred embodiment of the present invention.

As shown in FIG. 6, a sports skills training arrangement of a second embodiment illustrates an alternative mode of the first embodiment of the present invention, wherein The training arrangement of the second embodiment has the same structure of the first embodiment, except the connection between the tension strap 1' and the arm loop strap 2'.

As shown in FIG. 6, the arm loop strap 2' further comprises an elongated attachment strap 21', which is preferably made of elastic material such as elastic strap, transversely provided on the arm loop strap 2' to form at least a ring shaped attachment loop. Accordingly, the attachment strap 21' is stitched at evenly intervals to form a plurality of attachment loops. The tension strap 1' further comprises an arm loop strap clipping endpiece 13' provided at the second end of the tension strap 1' to detachably clip on the attachment loop of the attachment strap 21', so that the tension strap 1' is perpendicularly extended from the arm loop strap 2'.

Therefore, the individual is able to selectively fasten the tensions strap 1' at different positions on the arm loop strap 2' by selectively clipping the arm loop strap clipping endpiece 13' to one of the attachment loops of the attachment strap 21'.

It is obvious that the sports skills training arrangement can be used for racquet sports, golf, and basketball for promoting muscle memory of the human body. Moreover, the alternative modes of the waist adjuster 3 of the first embodiment can be simply incorporated with the tension strap of the second embodiment. While the foregoing description describes the preferred embodiments and their alternatives, it should be appreciated that certain obvious modifications, variations, and substitutions may be made without departing from the spirit and scope of the present invention. For example, loop size adjuster, the body connector, and the waist adjuster can be simply substituted by other conventional fastening element to perform the same functions as mentioned above.

What is claimed is:

1. A training arrangement for promoting sports skills of a user, comprising:

a fibrous length-adjusting tension strap having a first end and a second end;

an arm loop strap adapted for encircling an upper arm of said user, wherein said second end of said tension strap is perpendicularly attached to said arm loop strap, wherein said arm loop strap which has a predetermined length made of elastic material comprises a loop size adjuster connecting a first end portion and a second end portion of said arm loop strap to define an arm loop, wherein said loop size adjuster is adapted to adjust a diameter of said arm loop to equal to a diameter of a lower portion of said upper arm so as to fittingly fasten around said lower portion of said upper arm of said user and prevent an axial movement thereof, wherein said arm loop strap further has a longitudinal control region to attach said second end of said tension strap and a longitudinal retaining region extended sidewardly from said control region for retaining said arm loop strap around the upper arm of the user in position, wherein a width of said arm loop strap equals to a total width of said control region and said retaining region, so as to lengthen said width of said arm loop strap for securely fastening around the upper arm of the user;

a body connector affixed to said first end of said tension strap adapted for detachably attaching to a specific connection point of a waist portion of the user;

a waist adjuster, which is slidably mounted on said tension strap, defining a control portion of said tension strap between said second end thereof and said waist adjuster and a waist loop portion of said tension strap formed by connecting said body connector to said waist adjuster, wherein said waist adjuster is adapted to adjust a diameter of said waist loop portion to equal to a diameter of said waist portion of said user so as to fittingly fasten around said waist portion of said user;

a length adjustment means which is provided on the tension strap for adjusting a length of said control portion of said tension strap; and a guiding arm strap adapted for encircling another upper arm of said user while said arm loop strap is fastened to said upper arm of said user, wherein said guiding arm strap has a guiding loop provided thereon for said tension strap slidably passing through in such a manner that said control portion of said tension strap is extended from said waist adjuster to said arm loop strap through said guiding loop.

2. A training arrangement for promoting sports skills of a user, comprising:

a fibrous length-adjusting tension strap having a first end and a second end;

an arm loop strap adapted for encircling an upper arm of said user, wherein said second end of said tension strap is perpendicularly attached to said arm loop strap, wherein said arm loop strap which has a predetermined length made of elastic material comprises a loop size adjuster connecting a first end portion and a second end portion of said arm loop strap to define an arm loop, wherein said loop size adjuster is adapted to adjust a diameter of said arm loop to equal to a diameter of a lower portion of said upper arm so as to fittingly fasten around said lower portion of said upper arm of said user and prevent an axial movement thereof, wherein said arm loop strap further has a longitudinal control region to attach said second end of said tension strap and a longitudinal retaining region extended sidewardly from said control region for retaining said arm loop strap around the upper arm of the user in position, wherein a width of said arm loop strap equals to a total width of said control region and said retaining region, so as to lengthen said width of said arm loop strap for securely fastening around the upper arm of the user;

a body connector affixed to said first end of said tension strap adapted for detachably attaching to a specific connection point of a waist portion of the user, wherein said body connector comprises a spring clip adapted for detachably fastening on a belt loop of a pants worn on the user at the waist portion thereof;

a waist adjuster, which is slidably mounted on said tension strap, defining a control portion of said tension strap between said second end thereof and said waist adjuster and a waist loop portion of said tension strap formed by connecting said body connector to said waist adjuster, wherein said waist adjuster is adapted to adjust a diameter of said waist loop portion to equal to a diameter of said waist portion of said user so as to fittingly fasten around said waist portion of said user;

a length adjustment means which is provided on the tension strap for adjusting a length of said control portion of said tension strap; and a guiding arm strap adapted for encircling another upper arm of said user while said arm loop strap is fastened to said upper arm of said user, wherein said guiding arm strap has a guiding loop provided thereon for said tension strap slidably passing through in such a manner that said control portion of said tension strap is extended from said waist adjuster to said arm loop strap through said guiding loop.

3. A training arrangement for promoting sports skills of a user, comprising:

a fibrous length-adjusting tension strap having a first end and a second end;

an arm loop strap adapted for encircling an upper arm of said user, wherein said second end of said tension strap is perpendicularly attached to said arm loop strap, wherein said arm loop strap which has a predetermined length made of elastic material comprises a loop size adjuster connecting a first end portion and a second end portion of said arm loop strap to define an arm loop, wherein said loop size adjuster is adapted to adjust a diameter of said arm loop to equal to a diameter of a lower portion of said upper arm so as to fittingly fasten around said lower portion of said upper arm of said user and prevent an axial movement thereof, wherein said arm loop strap further has a longitudinal control region to attach said second end of said tension strap and a longitudinal retaining region extended sidewardly from said control region for retaining said arm loop strap around the upper arm of the user in position, wherein a width of said arm loop strap equals to a total width of said control region and said retaining region, so as to lengthen said width of said arm loop strap for securely fastening around the upper arm of the user;

a body connector affixed to said first end of said tension strap adapted for detachably attaching to a specific connection point of a waist portion of the user, wherein said body connector comprises a spring clip adapted for detachably fastening on a belt loop of a pants worn on the user at the waist portion thereof;

a waist adjuster, which is slidably mounted on said tension strap, defining a control portion of said tension strap between said second end thereof and said waist adjuster and a waist loop portion of said tension strap formed by connecting said body connector to said waist adjuster, wherein said waist adjuster is adapted to adjust a diameter of said waist loop portion to equal to a diameter of said waist portion of said user so as to fittingly fasten around said waist portion of said user;

a length adjustment means which is provided on the tension strap for adjusting a length of said control portion of said tension strap;

a sliding stopper slidably mounted on said waist loop portion of said tension strap for blocking up a sliding movement of said waist adjuster along said tension strap when said waist loop portion of said tension strap is encircled around the waist portion of the user; and a guiding arm strap adapted for encircling another upper arm of said user while said arm loop strap is fastened to said upper arm of said user, wherein said guiding arm strap has a guiding loop provided thereon for said tension strap slidably passing through in such a manner that said control portion of said tension strap is extended from said waist adjuster to said arm loop strap through said guiding loop.

4. A training arrangement for promoting sports skills of a user, comprising:

a fibrous length-adjusting tension strap having a first end and a second end;

an arm loop strap adapted for encircling an upper arm of said user, wherein said second end of said tension strap is perpendicularly attached to said arm loop strap, wherein said arm loop strap which has a predetermined length made of elastic material comprises a loop size adjuster connecting a first end portion and a second end portion of said arm loop strap to define an arm loop, wherein said loop size adjuster is adapted to adjust a diameter of said arm loop to equal to a diameter of a lower portion of said upper arm so as to fittingly fasten around said lower portion of said upper arm of said user and prevent an axial movement thereof, wherein said arm loop strap further has a longitudinal control region to attach said second end of said tension strap and a longitudinal retaining region extended sidewardly from said control region for retaining said arm loop strap around the upper arm of the user in position, wherein a width of said arm loop strap equals to a total width of said control region and said retaining region, so as to lengthen said width of said arm loop strap for securely fastening around the upper arm of the user;

a body connector affixed to said first end of said tension strap adapted for detachably attaching to a specific connection point of a waist portion of the user, wherein said body connector comprises a spring clip adapted for detachably fastening on a belt loop of a pants worn on the user at the waist portion thereof;

a waist adjuster, which is slidably mounted on said tension strap, defining a control portion of said tension strap between said second end thereof and said waist adjuster and a waist loop portion of said tension strap formed by connecting said body connector to said waist adjuster, wherein said waist adjuster is adapted to adjust a diameter of said waist loop portion to equal to a diameter of said waist portion of said user so as to fittingly fasten around said waist portion of said user, wherein said waist adjuster is integrally connected with said body connector to form a one-piece member, said body connector has a first elongated sliding slot to securely attach to said first end of said tension strap and a second elongated sliding slot embodied as said waist adjuster for said tension strap slidably passing through;

a length adjustment means which is provided on the tension strap for adjusting a length of said control portion of said tension strap; and a guiding arm strap adapted for encircling another upper arm of said user while said arm loop strap is fastened to said upper arm of said user, wherein said guiding arm strap has a guiding loop provided thereon for said tension strap slidably passing through in such a manner that said control portion of said tension strap is extended from said waist adjuster to said arm loop strap through said guiding loop.

* * * * *